US009329516B2

(12) United States Patent
Ng et al.

(10) Patent No.: US 9,329,516 B2
(45) Date of Patent: May 3, 2016

(54) DEINKABLE LIQUID TONER

(75) Inventors: Hou T. Ng, Campbell, CA (US); Sivapackia Ganapathiappan, Los Altos, CA (US); Albert Teishev, Rishon le-zion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

(21) Appl. No.: 14/234,173

(22) PCT Filed: Jul. 26, 2011

(86) PCT No.: PCT/US2011/045330

§ 371 (c)(1),
(2), (4) Date: Jan. 22, 2014

(87) PCT Pub. No.: WO2013/015787

PCT Pub. Date: Jan. 31, 2013

(65) Prior Publication Data

US 2014/0147172 A1 May 29, 2014

(51) Int. Cl.

| | |
|---|---|
| ***G03G 9/13*** | (2006.01) |
| ***G03G 9/087*** | (2006.01) |
| ***G03G 9/09*** | (2006.01) |
| ***G03G 9/125*** | (2006.01) |
| ***G03G 9/08*** | (2006.01) |
| ***G03G 15/10*** | (2006.01) |
| ***G03G 9/12*** | (2006.01) |

(52) U.S. Cl.

CPC ..... *G03G 9/131* (2013.01); *G03G 9/0804* (2013.01); *G03G 9/08728* (2013.01); *G03G 9/08731* (2013.01); *G03G 9/0928* (2013.01); *G03G 9/12* (2013.01); *G03G 9/125* (2013.01); *G03G 9/13* (2013.01); *G03G 9/132* (2013.01); *G03G 15/104* (2013.01)

(58) Field of Classification Search

CPC ..... G03G 9/12; G03G 9/131; G03G 9/133; G03G 9/081

See application file for complete search history.

(56) References Cited

U.S. PATENT DOCUMENTS

| | | | | |
|---|---|---|---|---|
| 4,520,088 | A | 5/1985 | Senga et al. | |
| 5,432,036 | A | 7/1995 | Beach et al. | |
| 5,572,274 | A * | 11/1996 | Lior et al. | 399/296 |
| 5,589,312 | A | 12/1996 | Horie et al. | |
| 5,667,927 | A | 9/1997 | Kubota et al. | |
| 5,932,629 | A | 8/1999 | Beck et al. | |
| 6,096,468 | A | 8/2000 | Ohno et al. | |
| 6,136,492 | A * | 10/2000 | Hardy et al. | 430/115 |
| 6,335,137 | B1 | 1/2002 | Suzuki et al. | |
| 6,488,808 | B2 | 12/2002 | Nguyen et al. | |
| 7,645,549 | B2 | 1/2010 | Vijayendran et al. | |
| 2003/0186157 | A1 * | 10/2003 | Teraoka et al. | 430/114 |
| 2009/0123188 | A1 | 5/2009 | Teshima | |

FOREIGN PATENT DOCUMENTS

| | | |
|---|---|---|
| JP | 2002055489 | 2/2002 |
| KR | 100490398 | 2/2005 |
| KR | 100853878 | 8/2008 |

* cited by examiner

*Primary Examiner* — Peter Vajda
(74) *Attorney, Agent, or Firm* — Dierker & Associates, P.C.

(57) ABSTRACT

A deinkable liquid toner is disclosed herein. The deinkable liquid toner includes a non-polar carrier fluid, a styrene-alkyl acrylate, and a colorant. The styrene-alkyl acrylate has a glass transition temperature ranging from about 65 C to about 100 C. A method for making the deinkable liquid toner and a printing system are also disclosed herein.

16 Claims, 2 Drawing Sheets

DEINKABLE LIQUID TONER

BACKGROUND

The present disclosure relates generally to deinkable liquid toners.

Recycling processes may be used to regenerate usable cellulose fibers from waste papers. Some recycling processes involve a deinking method, where ink/toner is removed from waste paper pulp. In some cases, the deinking method includes applying deinking chemicals to waste paper, which interact with and remove the inked portions of the paper. Such deinking processes may, in some instances, pose a challenge for the recycling of some digitally inked papers, including liquid electrophotographic printed images. This may be due, at least in part, to chemical interactions between digital inks/toners and the deinking chemicals traditionally used in deinking methods.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
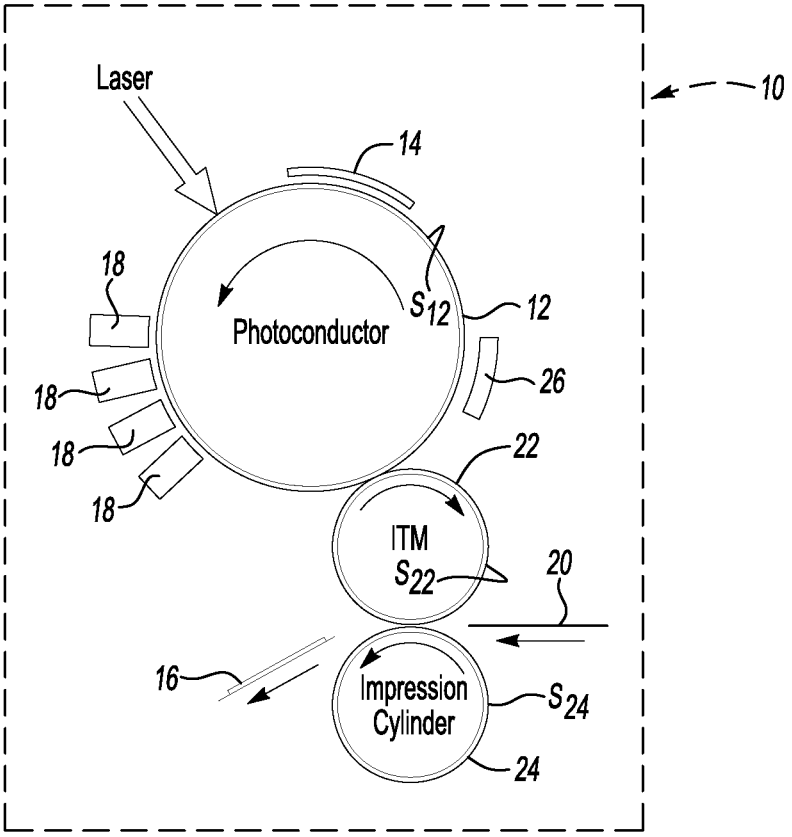
FIG. 1 is a schematic view of an example of a liquid electrophotographic printing system.

Processes for recycling printed waste papers, in some instances, involve converting the waste paper into a pulp, and then contacting the pulp with deinking chemicals. The deinking chemicals interact with the ink/toner, and then separate the ink/toner from the waste paper. This recycling process has suitably been used for waste papers printed using offset inks, but some challenges may exist for separating and removing digital inks/toners (e.g., LEP inks/toners) from waste papers. For instance, traditional deinking involves removing ink/toner particulates falling within a size range of about 10 microns to about 100 microns. Some challenges with removing digital ink/toner include finding a solution to aggregate the pigment particles or the dye molecules into a desired size range, and changing the physical properties of the particles/molecules from being too hydrophilic to more hydrophobic. It has been found that some existing deinking chemicals do not, in some instances, efficiently separate the ink/toner from fibers of a waste paper. It is believed that the challenge(s) is/are due, at least in part, to the material composition and/or properties of the digital ink/toner, which may, in some instances, adversely interact, or not at all, with the deinking chemicals used by the recycling mill. In many cases, the digital ink/toner cannot be separated and removed from the waste paper to an extent required for adequate waste paper recycling.

Some liquid toners include thermoplastics, which contribute to the formation of high-quality prints with consistent ink layer thickness that follows the surface contour of various media. While some deinking chemicals work particularly well with thermoplastics, other deinking chemicals are unable to effectively deink LEP prints containing thermoplastics.

Without being bound to any theory, it is believed that liquid toners may suitably be separated from waste papers by including a specific class of polymer components (other than thermoplastics) in the liquid toner. The class of polymer components is styrene-alkyl acrylates having a glass transition temperature ranging from about 65° C. to about 100° C. The active deinkable components of the styrene-alkyl acrylates render LEP prints deinkable via traditional deinking processes, such as alkaline-based deinking processes or neutral-based deinking processes. It has also been found that the styrene-alkyl acrylates disclosed herein do not deleteriously affect the printing and/or page attributes of the liquid toner.

The deinkable liquid toner disclosed herein may include a non-polar carrier fluid, the styrene-alkyl acrylate resin, and a colorant. In some instances, the deinkable liquid toner may also include thermoplastic resin(s) and/or charging agent(s). In other instances, no other additives are added.

The non-polar carrier fluid may make up the bulk of the deinkable liquid toner. As such, the amount of non-polar carrier fluid used depends at least upon the amount of styrene-alkyl acrylate resin and colorant used. In an example, the deinkable liquid toner may include the non-polar solvent in an amount ranging from about 95 wt % to about 99.95 wt % of the total weight of the deinkable liquid toner (e.g., after the liquid toner disclosed herein has additional carrier fluid added thereto to adjust the solids content for printing).

Examples of suitable non-polar carrier fluids include hydrocarbons, halogenated hydrocarbons, functionalized hydrocarbons (where functionalization can be accomplished using esters, ethers, ketones, sulfonic acid esters, and the like), or silicone oils. The hydrocarbon may be an aliphatic hydrocarbon, an isomerized aliphatic hydrocarbon, a branched chain aliphatic hydrocarbon, an aromatic hydrocarbon, or combinations thereof. In some examples, the non-polar carrier fluid may include isoparaffinic compounds, paraffinic compounds, dearomatized hydrocarbon compounds, and the like. Specific examples of suitable non-polar carrier fluids include Isopar-G™, Isopar-15 H™, Isopar-L™, Isopar-M™, Isopar-K™, Isopar-V™, Norpar 12®, Norpar 13®, Norpar 150, Exxsol D40T™, Exxsol D80™, Exxsol D100™, Exxsol D130™, and Exxsol D140™ (available from Exxon Mobil Corp.); Teclen N-16™, Teclen N-20™, Teclen N-22™, Nisseki Naphthesol L™, Nisseki Naphthesol M™, Nisseki Naphthesol H™, Solvent L™, Solvent M™, Solvent H™, Nisseki Isosol 300™, Nisseki Isosol 400™, AF-4™, AF-5™, AF-6™ and AF-7™ (available from Nippon Oil Corp.); IP Solvent 1620™ and IP Solvent 2028™ (available from Idemitsu Kosan); and Electron™, Positron™, and New II™ (available from Ecolink).

In an example, the styrene-alkyl acrylic resin(s) may replace traditional thermoplastic resins in the liquid toner. In another example, the styrene-alkyl acrylic resin(s) may be incorporated with traditional thermoplastic resins as a resin mixture in the liquid toner. In either example, the styrene-alkyl acrylic resin(s) may have a glass transition temperature ranging from about 65° C. to about 100° C.

In general, the styrene-alkyl acrylic resin may be i) a copolymer of styrene, butyl acrylate, and methacrylic acid; ii) a copolymer of styrene, butyl acrylate, methacrylonitrile, and methacrylic acid, iii) a copolymer of styrene, butyl acrylate, acrylonitrile, and methacrylic acid; iv) a copolymer of methyl methacrylate, hexyl acrylate, and methacrylic acid; v) a copolymer of methyl methacrylate, butyl acrylate, and methacrylic acid; or vi) a copolymer of styrene, N-phenyl maleimide, butyl acrylate, and methacrylic acid.

When the styrene-alkyl acrylic resin is a copolymer of styrene, butyl acrylate, and methacrylic acid, the copolymer may include from about 50% to about 90% of styrene, from about 10% to about 25% of butyl acrylate, and from about 0.2% to about 10% of methacrylic acid. In some examples, the copolymer may have a ratio of styrene:butyl acrylate:methacrylic acid equal to 80:18:2.

When the styrene-alkyl acrylic resin is a copolymer of styrene, butyl acrylate, methacrylonitrile or acrylonitrile, and methacrylic acid, the copolymer may include from about 40% to about 70% styrene, from about 10% to about 25% of butyl acrylate, from about 10% to about 25% of methacrylonitrile or acrylonitrile, and from about 0.2% to about 10% of methacrylic acid. In some examples, the copolymer may have a ratio of styrene:butyl acrylate:methacrylonitrile:methacrylic acid equal to 60:18:20:2. In other examples, the copolymer may have a ratio of styrene:butyl acrylate:acrylonitrile:methacrylic acid equal to 60:18:20:2.

When the styrene-alkyl acrylic resin is a copolymer of methyl methacrylate, hexyl acrylate or butyl acrylate, and methacrylic acid, the copolymer may include from about 50% to about 90% methyl methacrylate, from about 10% to about 25% of hexyl acrylate or butyl acrylate, and from about 0.2% to about 10% of methacrylic acid. In some examples, the copolymer may have a ratio of methyl methacrylate:hexyl acrylate:methacrylic acid equal to 85:13:2. In other examples, the copolymer may have a ratio of methyl methacrylate:butyl acrylate:methacrylic acid equal to 80:18:2 or 78:20:2.

When the styrene-alkyl acrylic resin is a copolymer of styrene, N-phenyl maleimide, butyl acrylate, and methacrylic acid, the copolymer may include from about 50% to about 80% of styrene, from about 5% to about 15% of N-phenyl maleimide, from about 10% to about 25% of butyl acrylate, and from about 0.2% to about 10% of methacrylic acid. In some examples, the copolymer may have a ratio of styrene:N-phenyl maleimide:butyl acrylate:methacrylic acid equal to 70:10:18:2.

The styrene-alkyl acrylic resins disclosed herein may be commercially available (e.g., from Specialty Polymers such as RayRez182A, RayRez182D and RayRez200) or may be manufactured from raw materials. The manufacturing may be accomplished via any suitable copolymer synthesis method.

In an example of forming the styrene-alkyl acrylic resin, an emulsion of the selected monomers (e.g., styrene, butyl acrylate, methacrylic acid, methacrylonitrile, etc.) may be prepared in water. The emulsion may or may not contain a small quantity (e.g., from about 0.1 wt % to about 3 wt % based upon the amount of monomers used) of anionic surfactants, such as sodium dodecylsulfate or MAXEMUL® 6106 (a non-migratory anionic surfactant available from Croda Coatings & Polymers). An initiator solution may also be prepared by dissolving potassium persulfate (or another polymerization initiator) in water. In this example, the emulsion and initiator solution may be simultaneously added to hot water (e.g., from about 80° C. to about 100° C.). This reaction mixture may be maintained at a temperature ranging from about 80° C. to about 100° C. for a predetermined time, and then may be cooled to ambient temperature. The pH of the final solution may be adjusted to a basic pH (e.g., 8.5) using a suitable base (e.g., a KOH solution). The solution may also be filtered, and water may be removed to obtain the styrene-alkyl acrylic resin particles.

As described in the previous example, the styrene-alkyl acrylic resin may be in the form of particles. The average particle size may be equal to or less than 5 μm. In an example, the average particle size of the styrene-alkyl acrylic resin particles may range from about 100 nm to about 500 nm.

As mentioned above, the styrene-alkyl acrylic resin(s) may be used as the only resin(s) in the liquid toner, or they may be used in a mixture with thermoplastic resin(s). Examples of suitable thermoplastic resins that may be used include copolymers of ethylene and acrylic acid; copolymers of ethylene and methacrylic acid; acrylonitrile butadiene styrene; polyethylene terephthalate; polyesters; polycarbonates; and mixtures thereof.

When used in the liquid toner without other resin(s), the styrene-alkyl acrylic resin(s) may make up 100% of the resin(s), and the amount of styrene-alkyl acrylic resin(s) present in the liquid toner may range from about 5 wt % to about 95 wt % of the total wt % of the liquid toner. When used in the liquid toner with other (e.g., thermoplastic) resin(s), the amount of styrene-alkyl acrylic resin(s) present in the liquid toner may range from about 10 wt % to about 80 wt % of the total wt % of the resin(s) used, and the amount of thermoplastic resin(s) present in the liquid toner may range from about 20 wt % to about 90 wt % of resin(s) used. In the latter example, the styrene-alkyl acrylate and thermoplastic resin together may be present in the deinkable liquid toner in an amount ranging from about 5 wt % to about 95 wt % of a total wt % of the liquid toner.

The liquid toner may also include one or more colorants. As used herein, the term "colorant" refers to i) one or more pigments, ii) one or more dyes, or iii) combinations of pigment(s) and dye(s). In an example, the colorant may be present in the liquid toner in an amount ranging from about 5 wt % to about 30 wt % of the total wt % of the liquid toner. Individual colorants may include more than one of the CMYK pigments or dyes and/or other base or secondary pigments or dyes, and may exhibit any color from various pigment or dye combinations, such as, any color within the available Pantone spot color space. Thus, in some examples, the pigments or dyes are cyan pigments or dyes, magenta pigments or dyes, yellow pigments or dyes, black pigments or dyes, or any combinations thereof.

Examples of suitable pigments include, but are not limited to, Mogul® L (Cabot, pigment black), Monastral Blue G (C.I. Pigment Blue 15, C.I. No. 74160), Quindo® Magenta (Mobay Chemical Co., Pigment Red 122), Indo Brilliant Scarlet Toner (Pigment Red 123, C.I. No. 71145), Dalamar® Yellow (Clariant AG Corp., Pigment Yellow 74, C.I. No. 11741), blue pigment BT-383D (DuPont), yellow pigment YT-10 717D (DuPont), red pigment RT-455D (DuPont), blue pigment Helioecht™ Blue GO (Bayer), and Paliotol® yellow D1155 (BASF).

The liquid toner disclosed herein may also include a charging agent. Examples of suitable charging agents include, but are not limited to, metallic stearates (e.g., aluminum tristearate, aluminum distearate, polyoxo aluminum stearate (POAS), Y(III) stearate, etc.), polyoxo aluminum palmitate, oxo-aluminum acrylates, or any other metallic salt whose leaving group is capable of dissolving or dispersing in the non-polar carrier fluid. The charging agent becomes part of the resin composition, by virtue of chemical bonding or physical association. When used, the charging agent may enhance the charge on the resin(s), and thus may enhance the electrophoretic behavior of the liquid toner.

When generating the liquid toner disclosed herein, the method may include mixing the styrene-alkyl acrylic resin(s) with the colorant, and adding this mixture to the non-polar carrier fluid or adding the non-polar carrier fluid to this mixture. The resulting dispersion may be mixed by mechanical means (e.g., stirrer, shaker, homogenizer, blender, or the like) and/or by ultrasonic agitation. The initial mixing process may be performed to reduce the particle size of the colorant(s) and/or the resin(s). As two examples, the dispersion may be sonicated in a probe sonicator or milled (e.g., via bead milling). The dispersion may then be further processed, e.g., microfluidization, ultrasonic agitation, high shear mechanical mixing, or the like, in order to disperse the colorant(s) further. In an example, the additional processing may be accomplished using a microfluidizer at maximum pressure. The dispersion may be processed for an amount of time sufficient to deagglomerate and further disperse the colorant particles, thereby forming the liquid toner.

The liquid toner that is formed may include the colorant(s) present in particle form, and the colorant particles are either physically associated with the resin(s) or are not physically associated with the resin(s). In an example, the colorant particles may be at least partially (and in some instances fully) encapsulated by the resin(s) and thus may be physically associated with the resin(s). In another example, the colorant particles and resin particles may coexist in the carrier fluid, but are not physically associated with one another.

The resulting liquid toner may have a solids content (e.g., resin(s) and colorant(s)) ranging from about 5 wt % to about 95 wt %. Once the liquid toner is formed, it may be adjusted so that the solids content ranges from about 0.05 wt % to about 5 wt % before printing. This may be accomplished by adding additional non-polar carrier fluid.

The liquid toner disclosed herein may be printed via a liquid electrophotographic printing system, an example of which is shown in FIG. 1. The printing system 10 includes a photoconductor 12 that is configured to rotate in a first direction (as denoted by the left pointing arrow in the photoconductor 12). The photoconductor 12 has a surface $S_{12}$ that may be exposed to various elements of the system 10 when the photoconductor 12 is rotated.

A corona generator 14 is operatively positioned adjacent to a portion of the surface $S_{12}$ of the photoconductor 12. The corona generator 14 may be a single wire or an array of wires (i.e., two or more) that are spaced apart by a distance ranging from about 500 μm to about 2 mm. Examples of suitable wire materials include metals, such as platinum, gold, palladium, titanium, alloys, etc. In the examples disclosed herein, the wire(s) of the generator 14 are positioned parallel to the plane of the surface (e.g., $S_{12}$) to be exposed to the corona discharge. This is believed to create a relatively uniform discharge field. The wire(s) of the generator 14 are also positioned 10 mm or less from the surface to be exposed to the corona discharge. It is to be generally understood that the corona generator 14 is capable of generating a relatively high electric field, where such electric fields are used by the digital printing system for image development and formation of an LEP image 16. In a non-limiting example, the electric charge or field of the corona discharge ranges from about 1 kV to about 5 kV when the current applied to the generator 14 ranges from about 1 μA to about 1000 μA.

When the system 10 is in operation, the corona discharge from corona generator 14 generates a charge on the portion of the photoconductor surface $S_{12}$ exposed to the discharge. It is to be understood that the photoconductor 12 rotates to develop a uniform layer of charge on the surface $S_{12}$. The charge may be positive or negative, depending upon the type of corona generator 14 used.

The system 10 also includes a laser (labeled "LASER" in FIG. 1) that is positioned adjacent to the photoconductor surface $S_{12}$. Generally, the laser is positioned such that as the photoconductor 12 rotates in the first direction, some of the areas of the surface $S_{12}$ exposed to the corona discharge from the generator 14 are exposed to the emission from the laser. The laser is selected so that its emission can generate charges opposite to those already present on the surface $S_{12}$ from within the photoconductor 12. By virtue of creating these opposite charges, the laser effectively neutralizes the previously formed charges at areas exposed to the laser emission. This neutralization forms a latent image. It is to be understood that those areas of the surface $S_{12}$ not exposed to the laser remain charged.

A controller or processor (not shown) operatively connected to the laser commands the laser to form the latent image so that the remaining charged portions of the surface $S_{12}$ can be used to generate the desirable digital image. The processor is capable of running suitable software routines or programs for receiving desirable digital images, and generating commands to reproduce the digital images using the laser, as well as other components of the system 10.

The system 10 further includes at least one toner reservoir/cartridge 18. Each of the reservoirs or cartridges 18 is associated with a fluid ejector or printhead (e.g., a thermal printhead or a piezoelectric printhead). Each reservoir/cartridge 18 houses the liquid toner disclosed herein. Loading of the liquid toner may be accomplished, e.g., by filling the reservoir 18 with the toner, which is operatively connected to the fluid ejector or printhead. The reservoir/cartridge 18 is then loaded into the printing system 10. It is to be understood that, in an example, the toners are selected to carry a charge that is opposite to that of the uniform layer of charge on the surface $S_{12}$. The reservoir(s)/cartridge(s) 18 are also operatively positioned to deposit the toner(s) onto the remaining charged portion(s) of the surface $S_{12}$ to form an ink layer (not shown) on the surface $S_{12}$ of the photoconductor 12. It is to be understood that the charges remaining on the surface $S_{12}$ after exposure to the laser will attract the oppositely charged toner(s).

Additionally or alternatively, it is to be understood that electrically neutral carrier(s) (i.e., toners without colorants) can be deposited on the discharged (i.e., neutralized) regions or the remaining charged regions of the surface $S_{12}$, so that a continuous layer is transferred to the substrate 20. Likewise, charged ink can be transferred from cartridge(s) 18 onto the discharged (i.e., neutralized) regions on the surface $S_{12}$ by applying an appropriate potential bias between the cartridges 18 and the surface $S_{12}$.

These examples of the system 10 also include an intermediate transfer medium (ITM) 22 and an impression cylinder (IC) 24. The ITM 22 may be, for example, a dielectric drum, that is configured to rotate in a second direction (denoted by the right pointing arrow), while the IC 24 is configured to rotate in the first direction (i.e., the same direction as the photoconductor 12, denoted by the left pointing arrow) that is opposite to the rotation direction of the ITM 22. The three components 12, 22, 24 operate such that the toner can be transferred from the photoconductor 12 to the ITM 22, and from the ITM 22 to the substrate 20, which is guided by the impression cylinder 24. While not shown, it is to be understood that each of the components are in operative communication with the controller or processor that is capable of running suitable software routines or programs for receiving desirable digital images, and generating commands to reproduce the digital images (LEP images) 16 on a substrate 20.

As the photoconductor 12 rotates, the toner is transferred to the surface $S_{22}$ of the intermediate transfer medium 22. The impression cylinder 24 guides the substrate 20 such that a surface of the substrate 20 contacts the toner on the intermediate transfer medium 22. When in contact, the toner transfers to the substrate 20.

The system 10 may also include a charge neutralization unit 26 positioned after the intermediate transfer medium 22 and adjacent to the surface $S_{12}$ of the photoconductor 12. The charge neutralization unit 26 neutralizes any opposite charges remaining on the surface $S_{12}$ of the photoconductor 12 prior to the next cycle of printing.

As mentioned herein, the liquid toner disclosed herein renders the LEP printed image deinkable. Fibers of the substrate 20 upon which the toner is directly deposited to form the printed image 16 may be recycled using a conventional paper recycling process. For example, the printed-on medium (having the liquid toner image 16 printed thereon) may be placed inside a recycling mill, and then the colorant of the toner deposited on the substrate 20 may be detached from the fibers of the substrate 20 to form a deinked pulp. The detaching of the colorant from the substrate 20 may be referred to herein as a deinking process. This deinking process may include introducing the printed-on medium into a pulper of the recycling mill, and then chopping the printed-on medium up into smaller pieces. In an alkaline-based process, pulping takes place in the presence of alkaline-based deinking chemicals, such as NaOH, a $Na_2SiO_3$ solution, Oleic Acid, and $H_2O_2$. It is to be understood that during the alkaline-based deinking processes, water may be added inside the pulper while the printed-on medium is chopped, thereby converting the printed article 10 into a slurry of pulp and ink.

Upon making the slurry, a flotation process is performed, which separates the toner from the slurry. When an alkaline-based deinking process is used, the slurry is introduced into a froth flotation cell. The flotation process of this example may take place in the presence or the absence of a frother. An example of a suitable frother is sodium dodecyl sulfate. The frother facilitates formation of foam which allows the removal of the detached ink particles from the fibers. More particularly, since the frother has an affinity to the now-detached colorant particles, the colorant particles attach to the frother foam. In an example, air is also blown into the slurry. The air bubbles lift the colorant particles to the surface of the flotation cell as a thick froth, which may be removed from the cell.

In some instances, the pulp slurry is screened to remove any materials that may be denser than the pulp, such as contaminants or other foreign matter. In an example, coarse and fine screening may be accomplished by passing the slurry over or through a screen with varying slot opening sizes to separate such materials from the slurry, and these materials may be caught using another mesh screen.

While an alkaline deinking process is described herein, it is to be understood that other deinking processes, such as neutral or near-neutral processes may be used.

To further illustrate the present disclosure, an example is given herein. It is to be understood that this example is provided for illustrative purposes and is not to be construed as limiting the scope of the disclosed example(s).

Example

A styrene-alkyl acrylate copolymer was formed. A monomer emulsion was prepared by emulsifying 320 g styrene, 72 g butyl acrylate, and 8 g methacrylic acid in 136 ml water containing 1.6 g MAXEMUL® 6106. An initiator solution was prepared by dissolving 1.39 g potassium persulfate in 160 ml water. 1160 ml water was heated to a temperature of 90° C. The initiator solution was slowly added to the hot water over a 35 minute period. Simultaneously, the emulsion was added to the hot water over a period of 33 minute period. The reaction mixture was maintained at a temperature of about 90° C. for an extended period of 2.5 hours, and then was cooled to ambient temperature. The pH of final solution was adjusted to 8.5 with 50% potassium hydroxide solution. The product was filtered with a 200 mesh filter to obtain copolymeric particles in water with about 20% solid content. The particle size was measured to be about 269 nm. The water in the polymeric solution was then removed to obtain the styrene/butyl acrylate/methacrylic acid copolymer.

The liquid toner was prepared by mixing 15.77 g styrene/butyl acrylate/methacrylic acid copolymer with 3.74 g yellow pigments and 0.48 g metallic stearate. 180 g ISOPAR® L and 66 g of 4 mm zirconia beads were added, and the mixture was milled for 16 hours. Next, the milling beads were removed and the resulting solution was microfluidized for one pass to obtain the final toner dispersion.

A portion of the resultant liquid toner was adjusted to 0.2% solid content with ISOPAR® L and mixed with a charge director. A uniform toner layer was successfully developed on paper coupons using an LEP printing system under a high electric field at about 1.5 kV. The electrophoretic behavior appeared to be similar as that of ELECTROINK® (a liquid toner used for LEP printing applications). For the deinking evaluation, numerous paper coupons were prepared.

For deinking, the paper coupons were pulped in the presence of a chemical set similar to that of INGEDE (International Association of the Deinking Industry) Method 11p. The chemical set is shown in Table 1.

TABLE 1

| Chemical | Dosage (% related to 200 g oven-dry paper) |
|---|---|
| NaOH | 1.2 g (0.6%) |
| Sodium silicate | 3.6 g (1.8%) |
| Oleic acid | 1.6 g (0.8%) |
| Calcium chloride dihydrate | 472 mg/l dilution water |
| $H_2O_2$ | 1.4 g (0.7%) |

Pulping was followed by a flotation process (about 12 minutes) in a flotation cell.

Effective removal of the toner layers was observed during the flotation process. Respective handsheets were made from all of the pulps (those obtained before and after flotation) to evaluate the efficiency of the deinking processes when the liquid toner disclosed herein was utilized to form the printed images. The sample pulps obtained before flotation are referred to herein as undeinked samples and the sample pulps obtained after flotation are referred to herein as deinked samples.

Figure 2A:
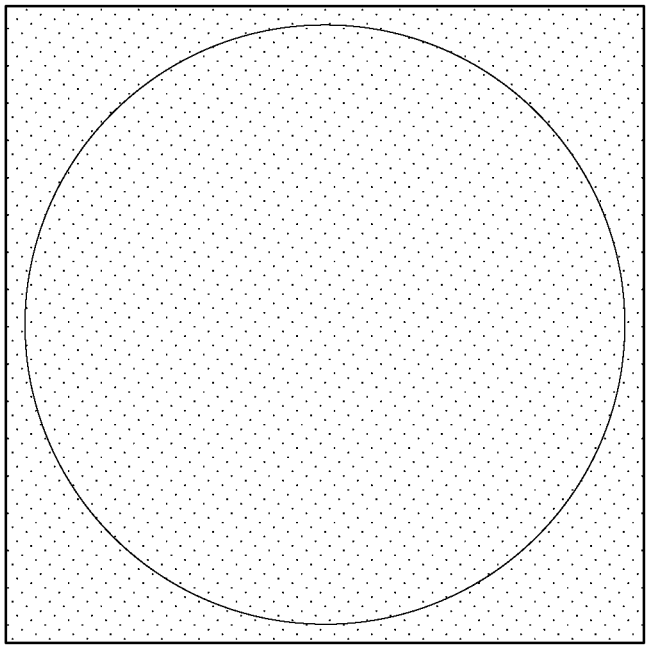
FIGS. 2A and 2B are schematic representations of handsheets made from non-deinked pulps (FIG. 2A) and deinked pulps (FIG. 2B), where the pulps are from LEP print media having an example of the deinkable liquid toner applied thereon.
Figure 2B:
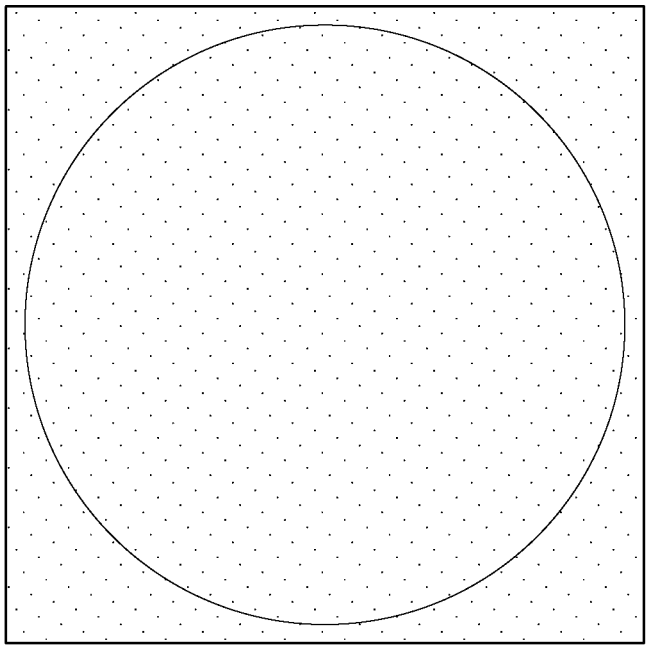

FIGS. 2A and 2B are schematic representations of the handsheets made from undeinked pulps (FIG. 2A) and deinked pulps (FIG. 2B). The ink speck counts on the deinked pulps (which were subjected to pulping and flotation) were found to be less than 50 (which is significantly less than the target level of 600, set by the European Recycling Paper Council's deinking score card). The handsheet of undeinked pulps showed some yellow specks while the deinked pulp had a few tiny spots that did not appear in the ink particle count.

Table 2 shows the results for the deinked pulps. The first section of Table 2 illustrates the European Recycling Paper Council's deinking score card parameters; and the second section of Table 2 illustrates the scores for the deinked pulps.

TABLE 2

| European Recycling Paper Council Deinking Scorecard's Parameters | | | | | | | |
|---|---|---|---|---|---|---|---|
| | Optical Brightness, Y | Color Shade, a* | Dirt, $A_{50}$ ($mm^2/m^2$) | Dirt, $A_{250}$ ($mm^2/m^2$) | Ink Elimination, IE (%) | Filtrate Darkening, ΔY | Total Score |
| Threshold | 47 | −3/+2 | 2000 | 600 | 40 | 18 | 100 |
| Target | 90 | −2/+1 | 600 | 180 | 80 | 6 | |
| Max Score | 35 | 20 | 15 | 10 | 10 | 10 | |
| Deinked Pulps | | | | | | | |
| Result | 85.1 | −0.6 | 27 | 0 | −6.8* | 2.9 | 96 |
| Score | 31 | 20 | 15 | 10 | 10 | 10 | |

*IE was negative because of an artifact due to high initial brightness; Full score was given.

As illustrated in Table 2, the optical brightness was close to the target level of 90. The filtrate darkening (i.e., an indication of the discoloration of the deinking process water) was 2.9, which is noticeably better than the target level of 6. The color shade was also well within the target range. The results shown in Table 2 are a summary of the key results of the deinking evaluation, and these results suggests that LEP prints formed with the liquid toner disclosed herein are deinkable.

It is to be understood that the ranges provided herein include the stated range and any value or sub-range within the stated range. For example, a range from about 0.1 wt % to about 30 wt % should be interpreted to include not only the explicitly recited limits of about 0.1 wt % to about 30 wt %, but also to include individual values, such as 0.2 wt %, 5 wt %, 12 wt %, etc., and sub-ranges, such as from about 0.5 wt % to about 10 wt %, from about 3 wt % to about 20 wt %, etc. Furthermore, when "about" is utilized to describe a value, this is meant to encompass minor variations (up to +/−10%) from the stated value.

Still further, it is to be understood use of the words "a" and "an" and other singular referents include plural as well, both in the specification and claims.

While several examples have been described in detail, it will be apparent to those skilled in the art that the disclosed examples may be modified. Therefore, the foregoing description is to be considered non-limiting.

What is claimed is:

1. A deinkable liquid toner, including:

a non-polar carrier fluid;

a non-thermoplastic styrene-alkyl acrylate having a glass transition temperature ranging from about 65° C. to about 100° C.; and a colorant;

wherein printed toner is removable from waste paper in response to an interaction between the printed toner and deinking chemicals;

and wherein the non-thermoplastic styrene-alkyl acrylate is chosen from copolymers of i) styrene, butyl acrylate, methacrylonitrile, and methacrylic acid, ii) styrene, butyl acrylate, acrylonitrile, and methacrylic acid; iii) methyl methacrylate, hexyl acrylate, and methacrylic acid; iv) methyl methacrylate, butyl acrylate, and methacrylic acid; and v) styrene, N-phenyl maleimide, butyl acrylate, and methacrylic acid.

2. The deinkable liquid toner as defined in claim 1 wherein any of:

a ratio of styrene:butyl acrylate:methacrylonitrile:methacrylic acid is 60:18:20:2;

a ratio of styrene:butyl acrylate:acrylonitrile:methacrylic acid is 60:18:20:2;

a ratio of methyl methacrylate:hexyl acrylate:methacrylic acid is 85:13:2;

a ratio of methyl methacrylate:butyl acrylate:methacrylic acid is chosen from 80:18:2 and 78:20:2; or a ratio of styrene:N-phenyl maleimide:butyl acrylate:methacrylic acid is 70:10:18:2.

3. The deinkable liquid toner as defined in claim 1 wherein:

the non-thermoplastic styrene-alkyl acrylate is the copolymer of styrene, butyl acrylate, methacrylonitrile or acrylonitrile, and methacrylic acid;

the copolymer includes from about 40% to about 70% styrene;

the copolymer includes from about 10% to about 25% of butyl acrylate;

the copolymer includes from about 10% to about 25% of methacrylonitrile or acrylonitrile; and the copolymer includes from about 0.2% to about 10% of methacrylic acid.

4. The deinkable liquid toner as defined in claim 1 wherein:

the non-thermoplastic styrene-alkyl acrylate is the copolymer of methyl methacrylate, hexyl acrylate or butyl acrylate, and methacrylic acid;

the copolymer includes from about 50% to about 90% methyl methacrylate;

the copolymer includes from about 10% to about 25% of hexyl acrylate or butyl acrylate; and the copolymer includes from about 0.2% to about 10% of methacrylic acid.

5. The deinkable liquid toner as defined in claim 1 wherein:

the non-thermoplastic styrene-alkyl acrylate is the copolymer of styrene, N-phenyl maleimide, butyl acrylate, and methacrylic acid;

the copolymer includes from about 50% to about 80% styrene;

the copolymer includes from about 5% to about 15% of N-phenyl maleimide;

the copolymer includes from about 10% to about 25% of butyl acrylate; and the copolymer includes from about 0.2% to about 10% of methacrylic acid.

6. The deinkable liquid toner as defined in claim 1, further including a thermoplastic resin selected from copolymers of ethylene and acrylic acid; copolymers of ethylene and methacrylic acid; acrylonitrile butadiene styrene; polyethylene terephthalate; polyesters; polycarbonate; and mixtures thereof.

7. The deinkable liquid toner as defined in claim 1 wherein the non-thermoplastic styrene-alkyl acrylate is present in the deinkable liquid toner in an amount ranging from about 5 wt % to about 95 wt % of a total wt % of the deinkable liquid toner.

8. The deinkable liquid toner as defined in claim 1, further including a charging agent.

9. The deinkable liquid toner as defined in claim 1 wherein a solids content of the toner ranges from about 0.05% to about 5%.

10. A method for making the deinkable liquid toner as defined in claim 1, the method including:

mixing the non-thermoplastic styrene-alkyl acrylate with the colorant to form a mixture;

adding the non-polar carrier fluid to the mixture to form a dispersion;

milling the dispersion; and microfluidizing the dispersion to obtain the deinkable liquid toner.

11. The method as defined in claim 10, further including manufacturing the non-thermoplastic styrene-alkyl acrylate.

12. A printing system, including:

at least one reservoir;

the deinkable liquid toner as defined in claim 1 stored in and dispensable from the at least one reservoir; and a fluid ejector operatively connected to the at least one reservoir to deposit the deinkable liquid toner onto a medium.

13. The printing system as defined in claim 12 wherein the printing system is a liquid electrophotographic printer, the medium is an intermediate transfer medium, and the liquid electrophotographic printer further comprises:

a photoconductor to rotate in a first direction and including a surface;

a corona generator positioned adjacent to the photoconductor surface to expose the photoconductor surface to corona discharge to form a uniform layer of charge thereon;

a laser positioned adjacent to the photoconductor surface to neutralize a portion of the uniform layer of charge on the photoconductor surface to form a latent image;

wherein the at least one fluid reservoir and fluid ejector are positioned to eject the deinkable liquid toner on a remaining charged portion of the uniform layer of charge to form a toner layer on the photoconductor surface;

the intermediate transfer medium positioned to receive the toner layer from the photoconductor; and an impression cylinder rotatable in the first direction to guide a substrate such that a surface of the substrate contacts the intermediate transfer system and receives the toner layer from the intermediate transfer medium.

14. A deinkable liquid toner, including:

a non-polar carrier fluid;

a styrene-alkyl acrylate having a glass transition temperature ranging from about 65° C. to about 100° C.; and a colorant;

wherein the styrene-alkyl acrylate is chosen from copolymers of i) styrene, butyl acrylate, and methacrylic acid; ii) styrene, butyl acrylate, methacrylonitrile, and methacrylic acid, iii) styrene, butyl acrylate, acrylonitrile, and methacrylic acid; iv) methyl methacrylate, hexyl acrylate, and methacrylic acid; v) methyl methacrylate, butyl acrylate, and methacrylic acid; and vi) styrene, N-phenyl maleimide, butyl acrylate, and methacrylic acid;

and wherein:

the styrene-alkyl acrylate is the copolymer of styrene, butyl acrylate, methacrylonitrile or acrylonitrile, and methacrylic acid;

the copolymer includes from about 40% to about 70% styrene;

the copolymer includes from about 10% to about 25% of butyl acrylate;

the copolymer includes from about 10% to about 25% of methacrylonitrile or acrylonitrile; and the copolymer includes from about 0.2% to about 10% of methacrylic acid.

15. A deinkable liquid toner, including:

a non-polar carrier fluid;

a styrene-alkyl acrylate having a glass transition temperature ranging from about 65° C. to about 100° C.; and a colorant;

wherein the styrene-alkyl acrylate is chosen from copolymers of i) styrene, butyl acrylate, and methacrylic acid; ii) styrene, butyl acrylate, methacrylonitrile, and methacrylic acid, iii) styrene, butyl acrylate, acrylonitrile, and methacrylic acid; iv) methyl methacrylate, hexyl acrylate, and methacrylic acid; v) methyl methacrylate, butyl acrylate, and methacrylic acid; and vi) styrene, N-phenyl maleimide, butyl acrylate, and methacrylic acid;

and wherein:

the styrene-alkyl acrylate is the copolymer of methyl methacrylate, hexyl acrylate or butyl acrylate, and methacrylic acid;

the copolymer includes from about 50% to about 90% methyl methacrylate;

the copolymer includes from about 10% to about 25% of hexyl acrylate or butyl acrylate; and the copolymer includes from about 0.2% to about 10% of methacrylic acid.

16. A deinkable liquid toner, including:

a non-polar carrier fluid;

a styrene-alkyl acrylate having a glass transition temperature ranging from about 65° C. to about 100° C.; and a colorant;

wherein the styrene-alkyl acrylate is chosen from copolymers of i) styrene, butyl acrylate, and methacrylic acid; ii) styrene, butyl acrylate, methacrylonitrile, and methacrylic acid, iii) styrene, butyl acrylate, acrylonitrile, and methacrylic acid; iv) methyl methacrylate, hexyl acrylate, and methacrylic acid; v) methyl methacrylate, butyl acrylate, and methacrylic acid; and vi) styrene, N-phenyl maleimide, butyl acrylate, and methacrylic acid;

and wherein:

the styrene-alkyl acrylate is the copolymer of styrene, N-phenyl maleimide, butyl acrylate, and methacrylic acid;

the copolymer includes from about 50% to about 80% styrene;

the copolymer includes from about 5% to about 15% of N-phenyl maleimide;

the copolymer includes from about 10% to about 25% of butyl acrylate; and the copolymer includes from about 0.2% to about 10% of methacrylic acid.

* * * * *